US010173096B2

(12) United States Patent
Gomberg et al.

(10) Patent No.: US 10,173,096 B2
(45) Date of Patent: Jan. 8, 2019

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US); Jason P. Faircloth, Woodacre, CA (US); Sean P. Allison, York, PA (US)

(73) Assignee: ROM3 Rehab LLC, Las Vegas, NV (US)

( * ) Notice: Subject to any disclaimer, the term of this patent is extended or adjusted under 35 U.S.C. 154(b) by 0 days.

(21) Appl. No.: 15/700,320

(22) Filed: Sep. 11, 2017

(65) Prior Publication Data

US 2018/0071570 A1 Mar. 15, 2018

Related U.S. Application Data

(60) Provisional application No. 62/393,348, filed on Sep. 12, 2016.

(51) Int. Cl.
*A63B 22/00* (2006.01)
*A63B 22/06* (2006.01)
(Continued)

(52) U.S. Cl.
CPC .... *A63B 22/0015* (2013.01); *A63B 21/00069* (2013.01); *A63B 21/015* (2013.01);
(Continued)

(58) Field of Classification Search
None
See application file for complete search history.

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 95019 1/1897
(Continued)

OTHER PUBLICATIONS

PCT International Search Report and Written Opinion, PCT/US17/50895 dated Jan. 12, 2018.

*Primary Examiner* — Stephen R Crow
(74) *Attorney, Agent, or Firm* — Luedeka Neely Group, PC

(57) ABSTRACT

An adjustable rehabilitation and exercise device, including a rotary member having a plurality of elongated and spaced apart elongated open-ended slots defined thereon; a mount selectively and movably positionable on a selected one of the slots of the rotary member to select an angular location of the mount. The mount includes a sliding member movably positionable along the selected slot to a selected radial location along the selected slot to select a radial location of the mount relative to the hub of the rotary member. The mount has a slide member configured to slidingly engage the slot and a movable plunger located on the slide member, wherein the plunger is movable to engage the slot so as to lock the position of the mount along the slot; and a patient engagement member connectable to the mount and movable with the mount.

3 Claims, 5 Drawing Sheets

(51) Int. Cl.

| | |
|---|---|
| ***A63B 21/00*** | (2006.01) |
| ***A63B 21/015*** | (2006.01) |
| ***A63B 69/16*** | (2006.01) |
| *A63B 21/22* | (2006.01) |

(52) U.S. Cl.

CPC ..... *A63B 22/0002* (2013.01); *A63B 22/0046* (2013.01); *A63B 22/0605* (2013.01); *A63B 69/16* (2013.01); *A63B 21/225* (2013.01); *A63B 22/0005* (2015.10); *A63B 22/0007* (2013.01); *A63B 2022/0611* (2013.01); *A63B 2022/0623* (2013.01); *A63B 2022/0635* (2013.01); *A63B 2069/161* (2013.01); *A63B 2220/30* (2013.01); *A63B 2225/09* (2013.01)

(56) References Cited

U.S. PATENT DOCUMENTS

| | | | | |
|---|---|---|---|---|
| 446,671 | A | 2/1891 | Elliott | |
| 610,157 | A | 8/1898 | Campbell | |
| 631,276 | A | 8/1899 | Bulova | |
| 823,712 | A | 6/1906 | Uhlmann | |
| 1,149,029 | A | 8/1915 | Clark | |
| 1,227,743 | A | 5/1917 | Burgedorff | |
| 1,784,230 | A | 12/1930 | Freeman | |
| 3,081,645 | A | 3/1963 | Bergfors | |
| 3,100,640 | A | 8/1963 | Weitzel | |
| 3,137,014 | A | 6/1964 | Meucci | |
| 3,143,316 | A | 8/1964 | Shapiro | |
| 3,713,438 | A | 1/1973 | Knutsen | |
| 3,888,136 | A | 6/1975 | Lapeyre | |
| 4,079,957 | A | 3/1978 | Blease | |
| 4,446,753 | A | 5/1984 | Nagano | |
| 4,477,072 | A | 10/1984 | DeCloux | |
| 4,509,742 | A * | 4/1985 | Cones | A63B 22/001 138/45 |
| 4,606,241 | A | 8/1986 | Fredriksson | |
| 4,611,807 | A * | 9/1986 | Castillo | A63B 21/0125 482/119 |
| 4,648,287 | A | 3/1987 | Preskitt | |
| 4,673,178 | A | 6/1987 | Dwight | |
| 4,850,245 | A | 7/1989 | Feamster et al. | |
| 4,858,942 | A | 8/1989 | Rodriguez | |
| 4,915,374 | A | 4/1990 | Watkins | |
| 4,930,768 | A | 6/1990 | Lapcevic | |
| 4,961,570 | A | 10/1990 | Chang | |
| 5,027,794 | A | 7/1991 | Pyle | |
| 5,161,430 | A * | 11/1992 | Febey | B62M 3/02 74/594.1 |
| 5,247,853 | A | 9/1993 | Dalebout | |
| D342,299 | S | 12/1993 | Birrell et al. | |
| 5,282,748 | A | 2/1994 | Little | |
| 5,316,532 | A * | 5/1994 | Butler | A63B 71/0009 482/111 |
| 5,324,241 | A | 6/1994 | Artigues et al. | |
| 5,336,147 | A | 8/1994 | Sweeney | |
| 5,338,272 | A | 8/1994 | Sweeney | |
| 5,361,649 | A | 11/1994 | Slocum | |
| 5,458,022 | A | 10/1995 | Mattfeld et al. | |
| 5,566,589 | A | 10/1996 | Buck | |
| 5,580,338 | A | 12/1996 | Scelta et al. | |
| 5,676,349 | A | 10/1997 | Wilson | |
| 5,685,804 | A * | 11/1997 | Whan-Tong | A63B 22/001 482/51 |
| 5,860,941 | A | 1/1999 | Saringer et al. | |
| 5,950,813 | A | 9/1999 | Hoskins et al. | |
| 6,053,847 | A | 4/2000 | Stearns et al. | |
| 6,077,201 | A | 6/2000 | Cheng | |
| 6,102,834 | A | 8/2000 | Chen | |
| 6,155,958 | A | 12/2000 | Goldberg | |
| 6,253,638 | B1 | 7/2001 | Bermudez | |
| 6,371,891 | B1 | 4/2002 | Speas | |
| 6,430,436 | B1 | 8/2002 | Richter | |
| 6,474,193 | B1 | 11/2002 | Farney | |
| 6,543,309 | B2 | 4/2003 | Heim | |
| 6,589,139 | B1 * | 7/2003 | Butterworth | B62M 3/02 482/57 |
| 6,640,662 | B1 | 11/2003 | Baxter | |
| 6,820,517 | B1 | 11/2004 | Farney | |
| 6,865,969 | B2 | 3/2005 | Stevens | |
| 6,895,834 | B1 | 5/2005 | Baatz | |
| 7,204,788 | B2 * | 4/2007 | Andrews | B62M 3/02 482/57 |
| 7,226,394 | B2 | 6/2007 | Johnson | |
| 7,594,879 | B2 * | 9/2009 | Johnson | A63B 22/0002 482/57 |
| 9,044,630 | B1 | 6/2015 | Lampert et al. | |
| 9,480,873 | B2 * | 11/2016 | Chuang | A63B 22/0015 |
| 2003/0092536 | A1 | 5/2003 | Romanelli et al. | |
| 2004/0194572 | A1 | 10/2004 | Kim | |
| 2005/0020411 | A1 | 1/2005 | Andrews | |
| 2005/0085353 | A1 | 4/2005 | Johnson | |
| 2005/0274220 | A1 | 12/2005 | Reboullet | |
| 2006/0003871 | A1 | 1/2006 | Houghton et al. | |
| 2008/0161166 | A1 | 7/2008 | Lo | |
| 2009/0211395 | A1 | 8/2009 | Mul'e | |
| 2012/0167709 | A1 | 7/2012 | Chen et al. | |
| 2017/0113092 | A1 | 4/2017 | Johnson | |
| 2018/0071565 | A1 * | 3/2018 | Gomberg | A63B 22/0015 |
| 2018/0071566 | A1 * | 3/2018 | Gomberg | A63B 22/0015 |
| 2018/0071569 | A1 * | 3/2018 | Gomberg | A63B 22/0015 |
| 2018/0071570 | A1 * | 3/2018 | Gomberg | A63B 22/0015 |
| 2018/0071571 | A1 * | 3/2018 | Gomberg | A63B 22/0015 |
| 2018/0071572 | A1 * | 3/2018 | Gomberg | A63B 22/0015 |

FOREIGN PATENT DOCUMENTS

| | | | |
|---|---|---|---|
| DE | 7628633 | U1 | 12/1977 |
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A3 | 4/2001 |
| EP | 0199600 | A2 | 10/1986 |
| EP | 0634319 | B1 | 10/1999 |
| EP | 1034817 | A1 | 9/2000 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

* cited by examiner

ADJUSTABLE REHABILITATION AND EXERCISE DEVICE

CROSS-REFERENCE TO RELATED APPLICATION

This application claims priority to U.S. Provisional Application No. 62/393,348 filed Sep. 12, 2016, entitled ADJUSTABLE REHABILITATION AND EXERCISE DEVICE, incorporated herein by reference in its entirety.

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable relative to one another have been proposed. However, such designs require improvement due to the fact that the pedals tend to not remain securely mounted and detach, wobble and the like. In addition, it is desirable to provide for an adjustable rehabilitation or exercise device that is capable of providing both powered motion or user initiated motion without the need for separate devices.

Accordingly, in one aspect, the disclosure provides an adjustable rehabilitation and exercise device having improved structure for locating patient engagement members.

SUMMARY

The disclosure provides an adjustable rehabilitation and exercise devices.

In one aspect, an adjustable rehabilitation and exercise device includes a rotary member having a plurality of elongated and spaced apart elongated open-ended slots defined thereon; a mount selectively and movably positionable on a selected one of the slots of the rotary member to select an angular location of the mount.

The mount includes a sliding member movably positionable along the selected slot to a selected radial location along the selected slot to select a radial location of the mount relative to the hub of the rotary member.

The mount has a slide member configured to slidingly engage the slot and a movable plunger located on the slide member, wherein the plunger is movable to engage the slot so as to lock the position of the mount along the slot; and a patient engagement member connectable to the mount and movable with the mount.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
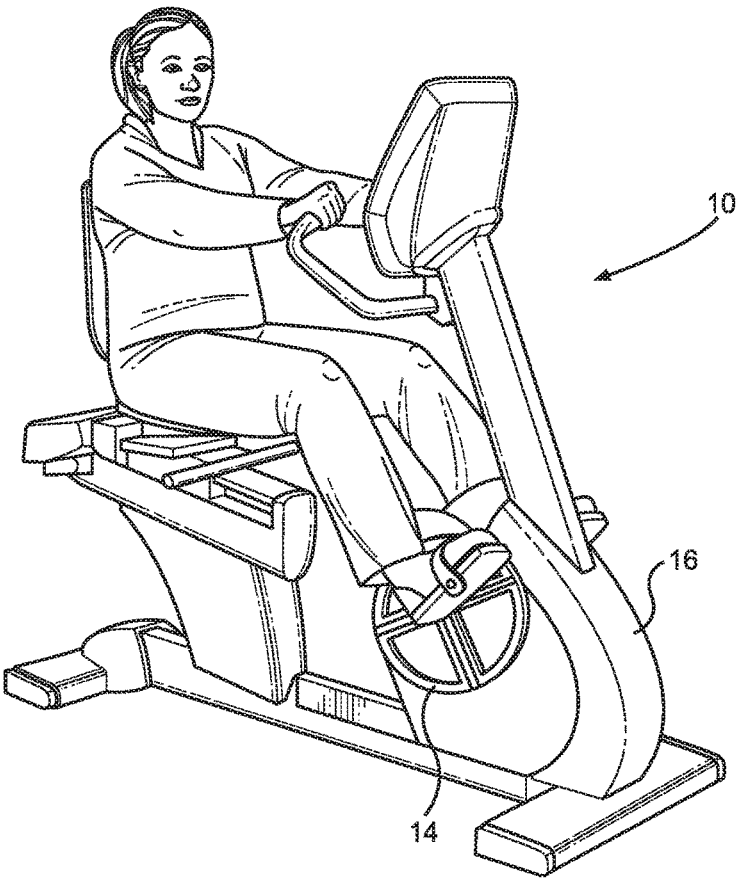
FIGS. 1A and 1B are perspective views of an adjustable rehabilitation and exercise device according to the disclosure configured to have adjustably positionable patient engagement members.
Figure 1B:
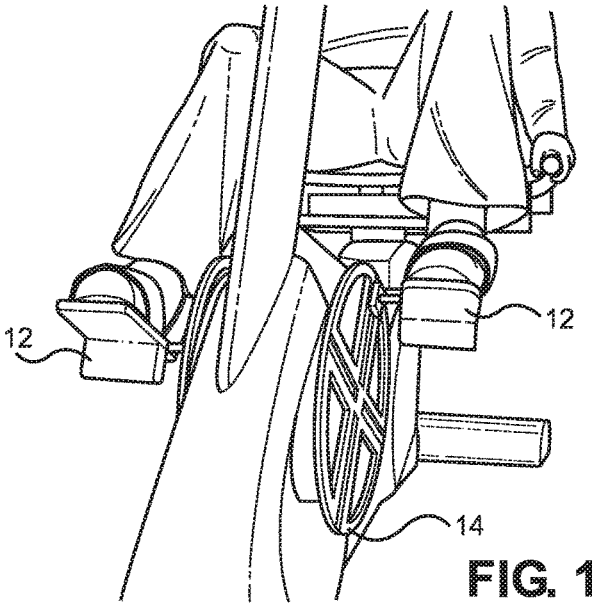

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a hub to a frame 16 or other support. The pedal 12 is configured for interacting with a patient to be rehabilitated and may be configured for use with lower body extremities such as the feet, legs, or upper body extremities such as the hands, arms, and the like. For example, the pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

With reference to FIGS. 2A-2E, there is shown a wheel system 20 having a patient engagement member, such as a pedal adjustably mountable on a wheel 24 by an adjustable mount 26.

The wheel 24 is a disk configured to include a plurality of spaced apart elongated slots 24*a* formed on a front surface of the wheel 24 to receive the mount 26. The wheel 24 also includes a central mounting aperture 24*b* to provide a hub for rotatably mounting of the wheel 24 to the device 10. Material of the wheel 24 may be removed to provide openings 24*c* to provide aesthetics and for reducing the weight and the cost of the wheel 24.

The mount 26 includes a sliding member 26*a* configured to slidingly engage the slot 24*a*. The sliding member 26*a* includes a lever 26*b* located thereon for engaging a plunger 26*c*. The mount also includes a receiver 26*d* located on the sliding member 26*c* and configured to receive an axle of the pedal or other patient engagement member.

Figure 2A:
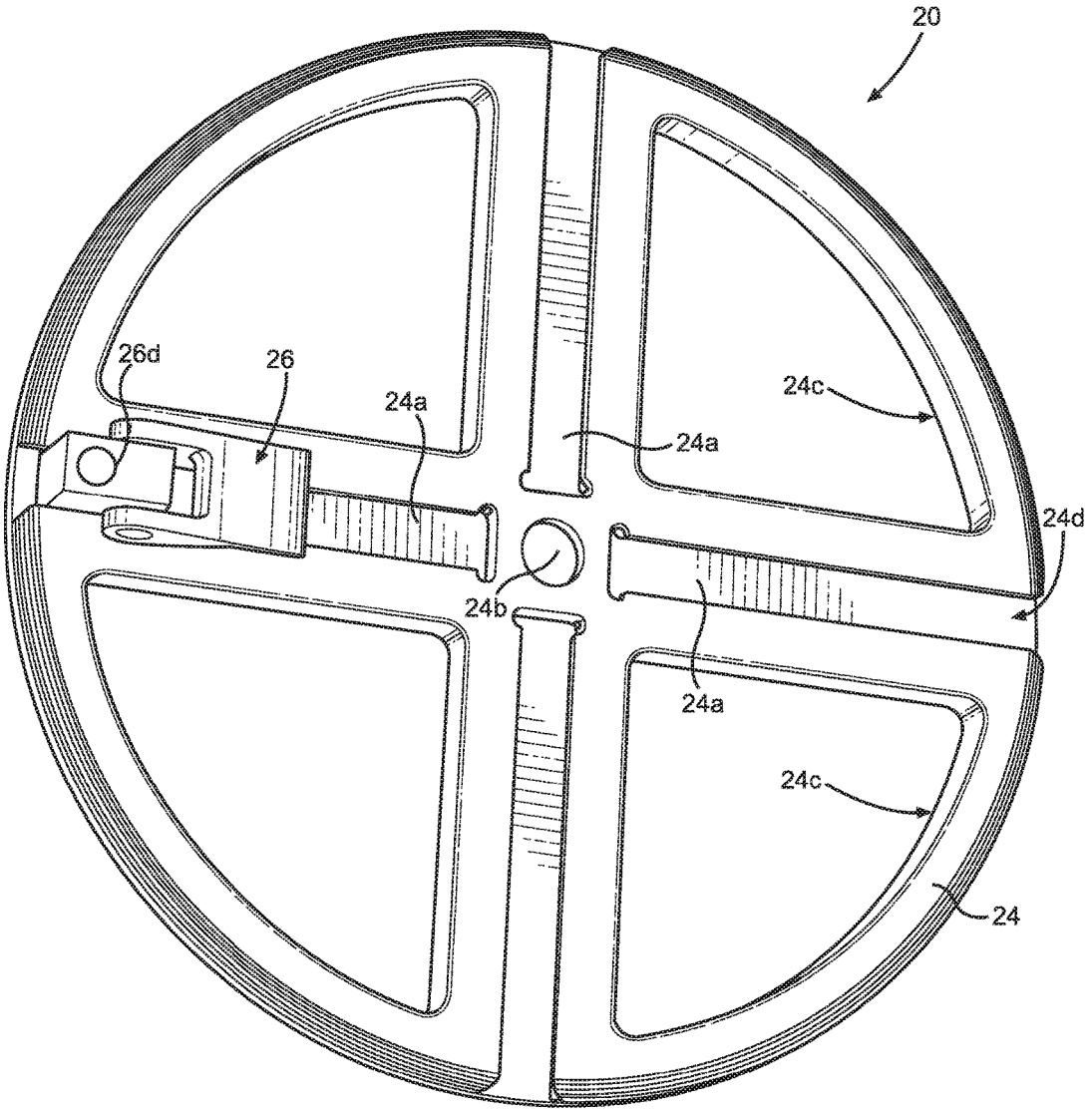
FIGS. 2A-2E show a wheel system for adjustably positioning a patient engagement member.
Figure 2B:
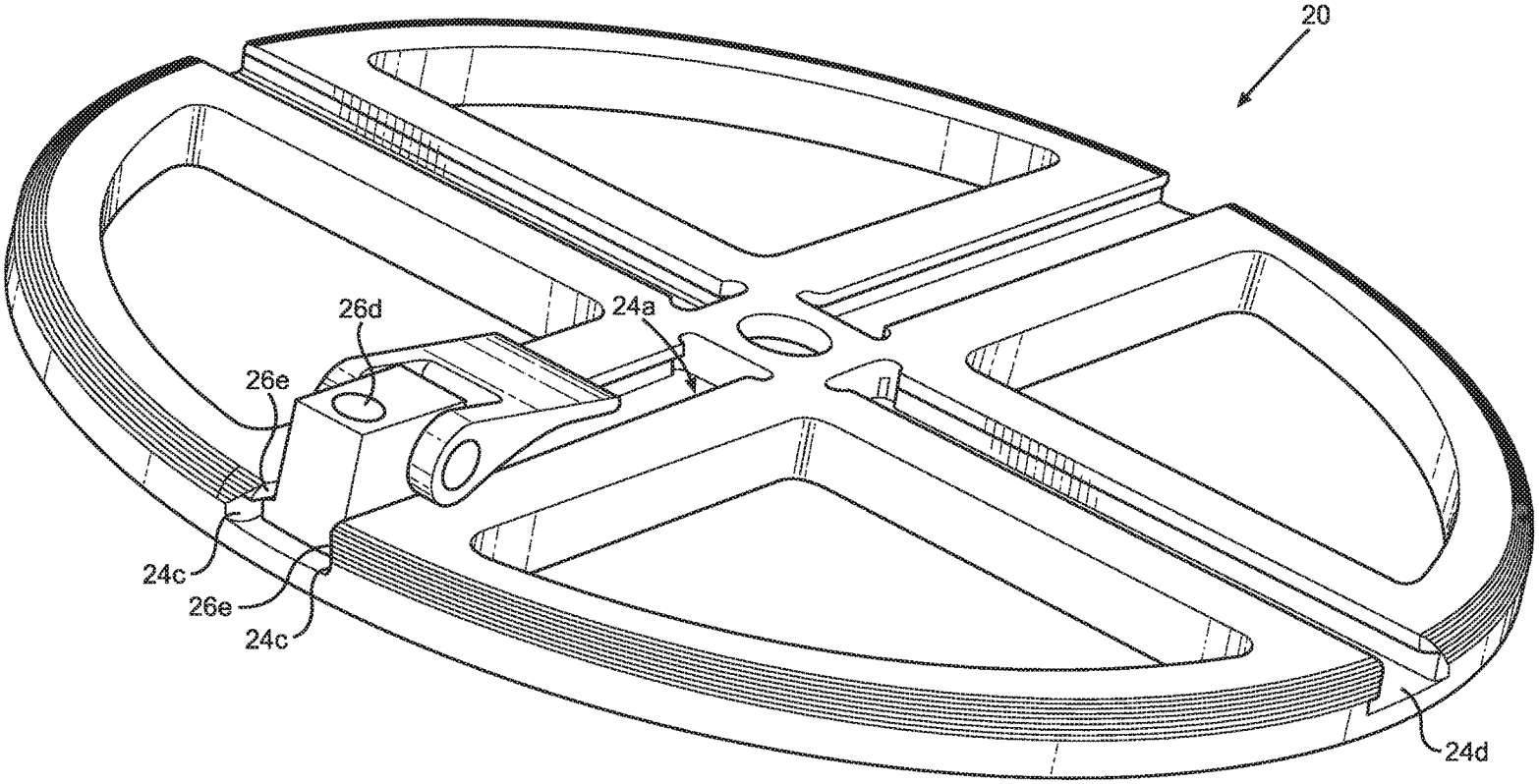
Figure 2C:
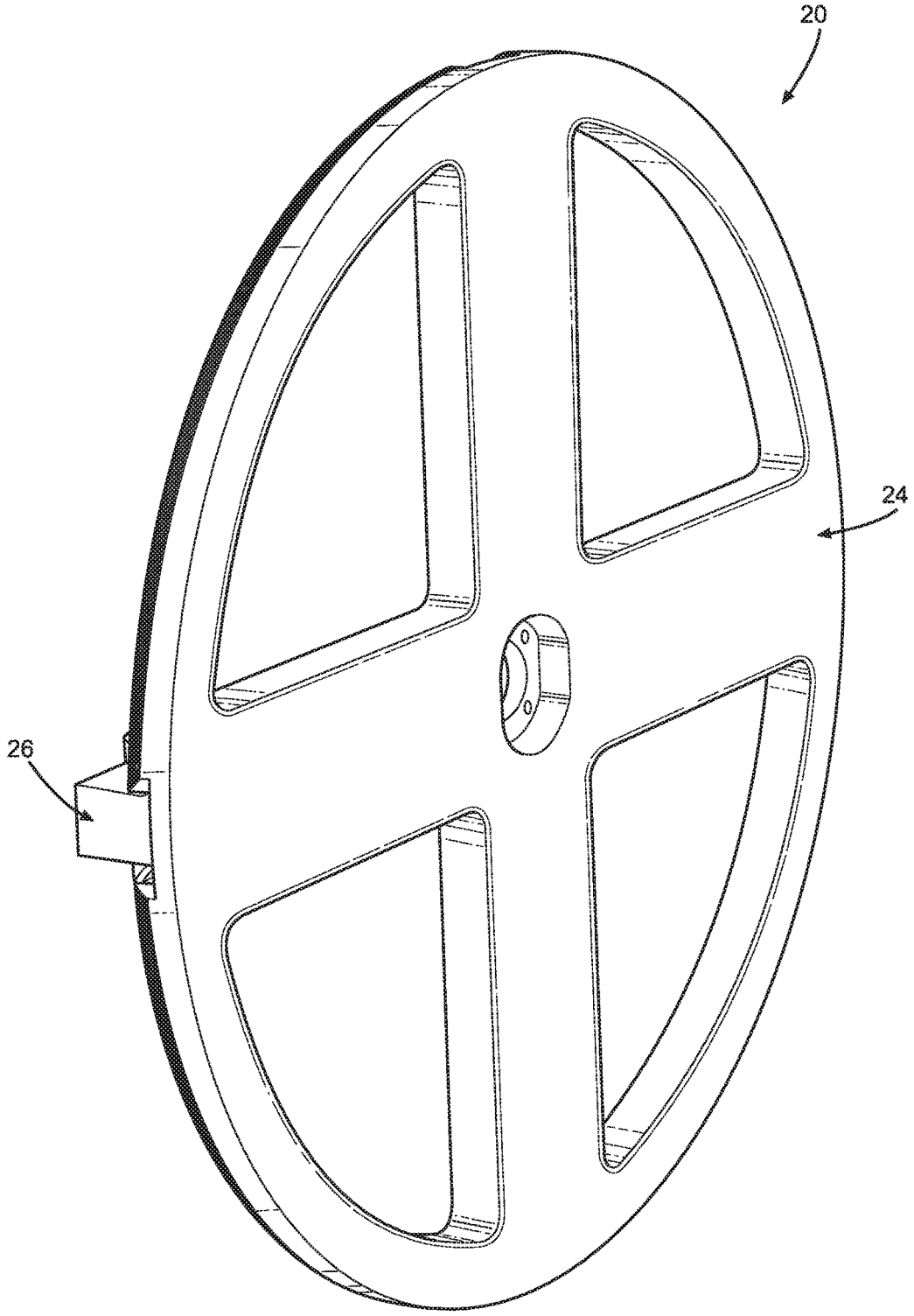

As seen in FIG. 2B, the slot 24*a* has an open end 24*d* and flared surfaces 24*e* that correspond to flared exterior surfaces 26*e* of lower portions of the sliding member 26*a* so that the sliding member 26*a* must be inserted from the open end 24*d* of the slot 24*a* and is retained within the slot 24*a* unless removed from the open end of the slot 24*a*.

Figure 2D:
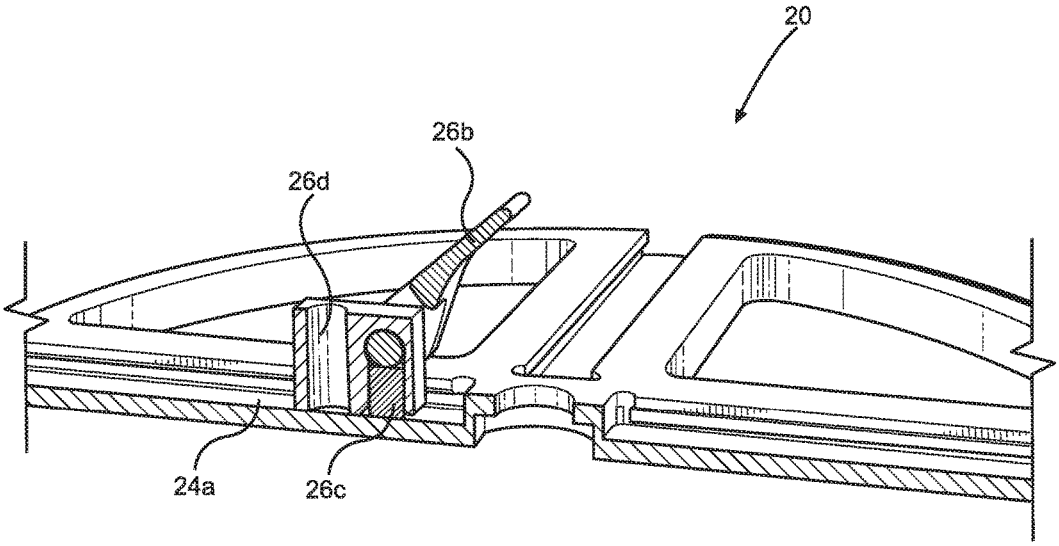
Figure 2E:
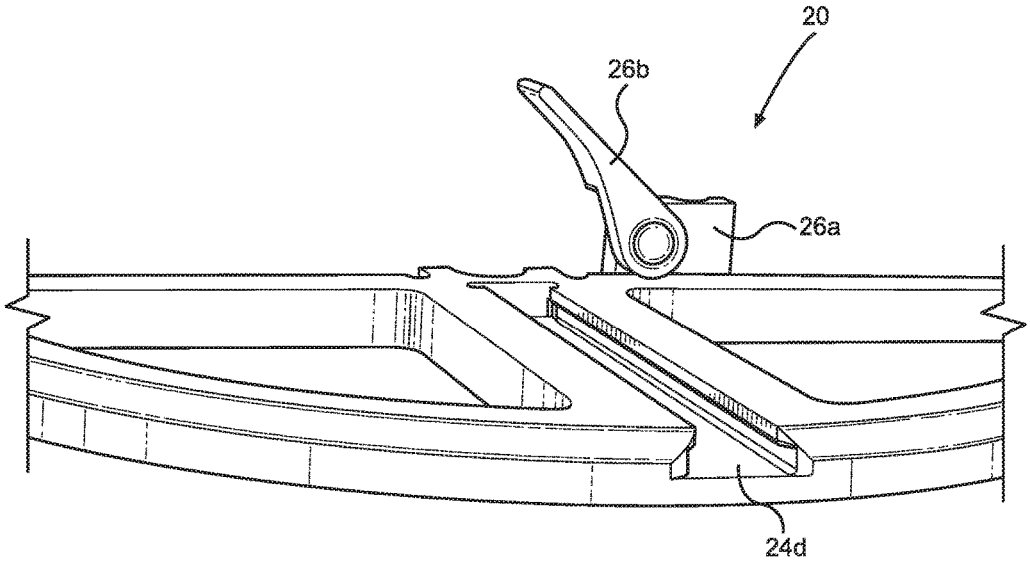

With reference to FIG. 2D, the lever 26*b* may be raised to disengage the plunger 26*c* from frictional contact with a floor of the slot 24*a*. When the plunger 26*c* is disengaged from the floor of the slot 24*a*, the sliding member 26*a* may be moved along the slot to change its radial location on the wheel 24. When the sliding member 26*a* is at a desired radial location, the lever 26*b* may be operated to force and maintain the plunger 26*c* against the floor of the slot 24*a* and thereby lock the radial location of the sliding member 26*a*.

The mount 26 is configured to stably locate a pedal or other patient engagement member and eliminate wobble and the like associated with conventional devices. In addition, the mount 26 is also configured to advantageously enable substantially incremental adjustment of the position of the mount.

The mount 26 cooperates with the slot 24*a* to adjustably position the mount 26, and hence the pedal, relative to the hub of the wheel 24. Further, the availability of a plurality of slots 24*a* enables a user to select which slot 24*a* for installation of the mount 26. Thus, in combination, the mount 26 and the slots 24*a* enable radial and angular adjustment of the position of the pedal or other patient engagement member. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure

The invention claimed is:

1. An adjustable rehabilitation and exercise device, comprising:

a rotary member having a plurality of elongated and spaced apart elongated open-ended slots defined thereon;

a mount selectively and movably positionable on a selected one of the slots of the rotary member to select an angular location of the mount, the mount including a sliding member movably positionable along the selected slot to a selected radial location along the selected slot to select a radial location of the mount relative to the hub of the rotary member, the mount comprising a slide member configured to slidingly engage the slot and a movable plunger located on the slide member, wherein the plunger is movable to frictionally engage the slot so as to lock the position of the mount along the slot; and a patient engagement member connectable to the mount and movable with the mount.

2. The device of claim 1, wherein the slots include flared surfaces to fittingly receive corresponding flared external surfaces of the sliding member.

3. The device of claim 1, wherein the mount further comprises a lever operatively associated with the plunger, the lever operable to move the plunger to selectively engage or disengage the plunger from the slot.

* * * * *